United States Patent [19]

Goubeaux

[11] Patent Number: 4,636,097

[45] Date of Patent: Jan. 13, 1987

[54] REPLACEABLE INKING CARTRIDGE WITH DEPLETION COUNTER

[75] Inventor: Donald E. Goubeaux, Miamisburg, Ohio

[73] Assignee: Monarch Marking Systems, Inc., Dayton, Ohio

[21] Appl. No.: 356,077

[22] Filed: Mar. 8, 1982

Related U.S. Application Data

[63] Continuation of Ser. No. 152,058, May 20, 1980, abandoned.

[51] Int. Cl.[4] ..... B41J 35/28

[52] U.S. Cl. ..... 400/196.1; 400/197; 400/202.4; 400/208; 400/249

[58] Field of Search ..... 400/194, 195, 196, 196.1, 400/207, 208, 208.1, 231, 247, 197, 198, 199, 200, 201, 202, 202.1, 202.2, 202.3, 202.4; 101/351; 242/57

[56] References Cited

U.S. PATENT DOCUMENTS

| | | | |
|---|---|---|---|
| 2,539,764 | 1/1951 | Wisegarver | 242/57 X |
| 3,143,963 | 8/1964 | Schrempp | 101/351 |
| 3,167,264 | 1/1965 | Ohtsu | 242/57 X |
| 3,561,581 | 2/1971 | Takenaka | 400/194 X |
| 3,604,549 | 9/1971 | Candill et al. | 400/208 |
| 3,831,731 | 8/1974 | Mack et al. | 400/196 |
| 3,904,015 | 9/1975 | Boyden et al. | 400/196.1 X |
| 3,941,231 | 3/1976 | Matuck et al. | 400/196.1 |
| 4,046,247 | 9/1977 | La Spesa et al. | 400/196 |
| 4,091,913 | 5/1978 | Ku et al. | 400/196 X |
| 4,091,914 | 5/1978 | Stipanuk | 400/208 X |
| 4,111,378 | 9/1978 | Barwick | 400/249 |
| 4,115,013 | 9/1978 | Hedstrom | 400/208 X |
| 4,132,485 | 1/1979 | Hess | 400/208 X |

FOREIGN PATENT DOCUMENTS

| | | | |
|---|---|---|---|
| 2550305 | 5/1977 | Fed. Rep. of Germany | 400/202.4 |
| 2646336 | 4/1978 | Fed. Rep. of Germany | 400/249 |
| 2717668 | 10/1978 | Fed. Rep. of Germany | 400/249 |
| 2742974 | 3/1979 | Fed. Rep. of Germany | 400/249 |
| 2746059 | 4/1979 | Fed. Rep. of Germany | 400/249 |

OTHER PUBLICATIONS

Spotts, Design of Machine Elements 5th Ed. Prentice-Hall Englewood Cliffs, N.J., pp. 491, 493, 1978.

Candill, "Ribbon Usage Indicator" IBM Technical Disclosure Bulletin vol. 8, No. 8, Jan. 1966, pp. 1137-1138.

*Primary Examiner*—Charles A. Pearson

*Attorney, Agent, or Firm*—Joseph J. Grass

[57] ABSTRACT

There is disclosed a replaceable inking cartridge for a printer. The inking cartridge includes an arrangement for indicating when the inking medium of the cartridge has been spent. The indicating arrangement is non-resettable so that the user is prevented from using a spent cartridge for additional printing. The indicating means is useful for signalling the user or the printer about the spent condition of the cartridge.

14 Claims, 5 Drawing Figures

REPLACEABLE INKING CARTRIDGE WITH DEPLETION COUNTER

CROSS-REFERENCE TO RELATED APPLICATION

This is a continuation of parent application Ser. No. 152,058, filed May 20, 1980, now abandoned.

BACKGROUND OF THE INVENTION

1. Field of the Invention

This invention relates to the art of inking cartridges.

2. Brief Description of the Prior Art

Representative prior art inking cartridges are disclosed in U.S. Pat. Nos. 3,831,731 to Mack et al, granted Aug. 27, 1974, 3,904,015 to Boyden et al, granted Sept. 9, 1975, 3,941,231 to Matuck et al, granted Mar. 2, 1976 and 4,046,247 to La Spesa et al, granted Sept. 6, 1977. U.S. Pat. No. 3,143,963 to Schrempp, granted Aug. 11, 1964, discloses a device for locking out a printing device after a certain number of printing cycles.

SUMMARY OF THE INVENTION

This invention relates to a low-cost, compact, simple replaceable inking cartridge incorporating an arrangement for indicating when the inking medium which the cartridge contains has been spent. The indicating arrangement is non-resettable by the user. The cartridge is capable of signalling a printer of the spent condition of the cartridge so that either the user can be informed of the spent condition by visual or audible means or the printer can be disabled, or both.

According to a specific embodiment of the invention, the inking medium is held captive by the housing. The housing contains means for indicating when the cartridge needs to be replaced. The indicator means is inaccessible for resetting by the user so that a spent cartridge cannot be inadvertently or even intentionally used. The use of a spent cartridge would mean that the printer can be employed to produce a large number of records such as tags or labels which may not be ultimately useable because their quality is inadequate to meet specifications or the user's requirements. Print quality is particularly important when printing records which are intended to be read or scanned by a machine.

In accordance with a specific embodiment of the invention, there is provided a replaceable inking cartridge having an essentially closed housing with first and second chambers interconnected by an opening. The first chamber can be considered to be a stuffing chamber. The housing has a pair of outwardly extending arms. The housing provides a path for an endless ink ribbon. The path extends from the stuffing chamber, through one arm, to and through the other arm, to and through the second chamber, through the opening and into the stuffing chamber. A pair of feed rolls is disposed at the opening. One of the feed rolls can be driven from outside the housing. A spring-biased fountain roll in the second chamber transfers ink to the driven feed roll which in turn transfers the ink to the ink ribbon. The housing contains a counter which includes a pawl and ratchet mechanism operable from outside the housing. The pawl and ratchet mechanism drives a speed reducer in the housing which specifically takes the form of a worm gear and a worm wheel. When the worm wheel travels through a predetermined distance, a sensing member cooperating with the worm wheel moves from a first position to a second position thereby indicating that the inking ribbon is near the end of its useful life. This provides an indication representative of the useful life of the ribbon because the pawl and ratchet mechanism is operated by signals from the printer. The signals for the printer are generated in response to the predetermined number of cycles of operation of the printer to which the useful life of the ribbon correlates.

DETAILED DESCRIPTION OF THE PREFERRED EMBODIMENTS

Figure 1:
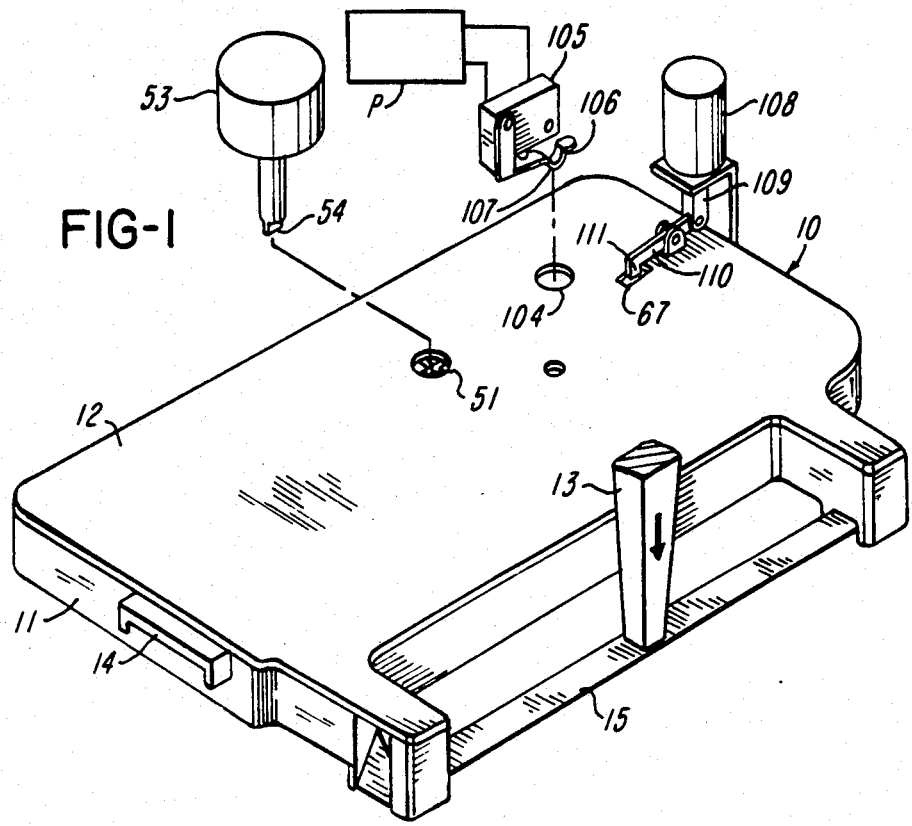
FIG. 1 is a partly exploded perspective view of a replaceable inking cartridge and parts of a printer.

With reference to FIG. 1, there is shown a replaceable ink ribbon cartridge generally indicated at 10. The cartridge 10 includes a housing 11 having a cover 12. The cover 12 is preferably permanently secured to the rest of the housing 11. The housing 11 is removably connected by suitable means 14 to a printer P having a print head 13.

Figure 2:
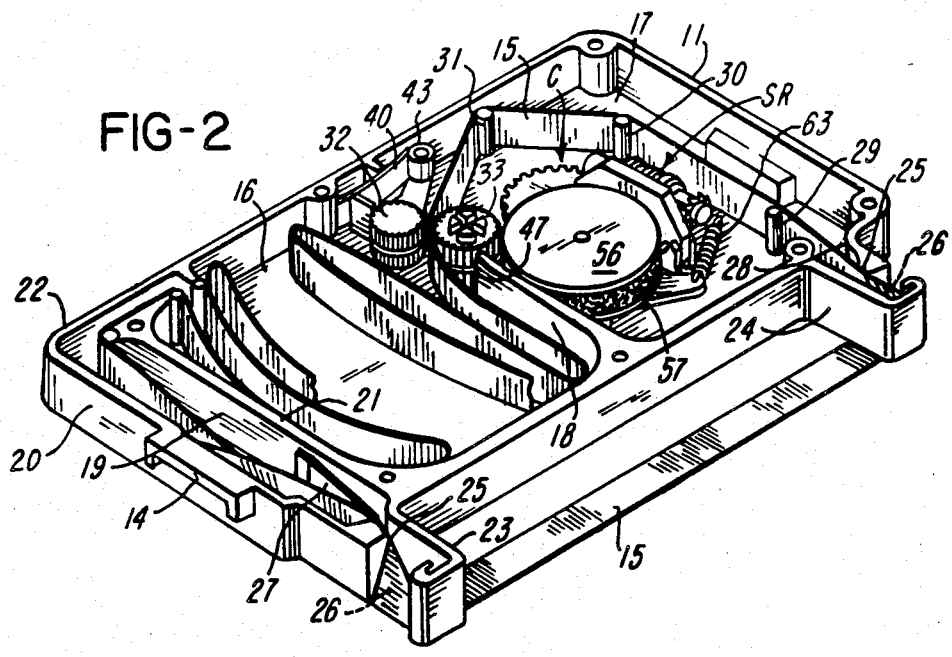
FIG. 2 is a perspective view of the cartridge minus the cover.

As best shown in FIG. 2, the housing 11 carries an endless ink ribbon 15. The ribbon 15 is held captive by the housing 11. The interior space of the housing 11 is shown to be separated into chambers 16 and 17 by wall structure 18. The chamber 16 is considered to be a stuffing chamber into which the ink ribbon 15 is stuffed in a random orientation. The housing 11 provides a path for the ink ribbon 15 from the chamber 16 through a passageway 19 provided by walls 20 and 21 and by a side wall 22 of the housing 11. The ribbon 15 makes a Mobius twist in the passageway 19. The housing 11 has a pair of outwardly extending arms 23 and 24 each of which has two turning bars 25 so that the ink ribbon 15 is presented in a horizontal plane as shown in FIGS. 1 and 2 into cooperation with the print head 13. A leaf spring 27 in the passageway 19 assists in providing the proper tension in the ink ribbon 15.

Figures 3, 4, 5:
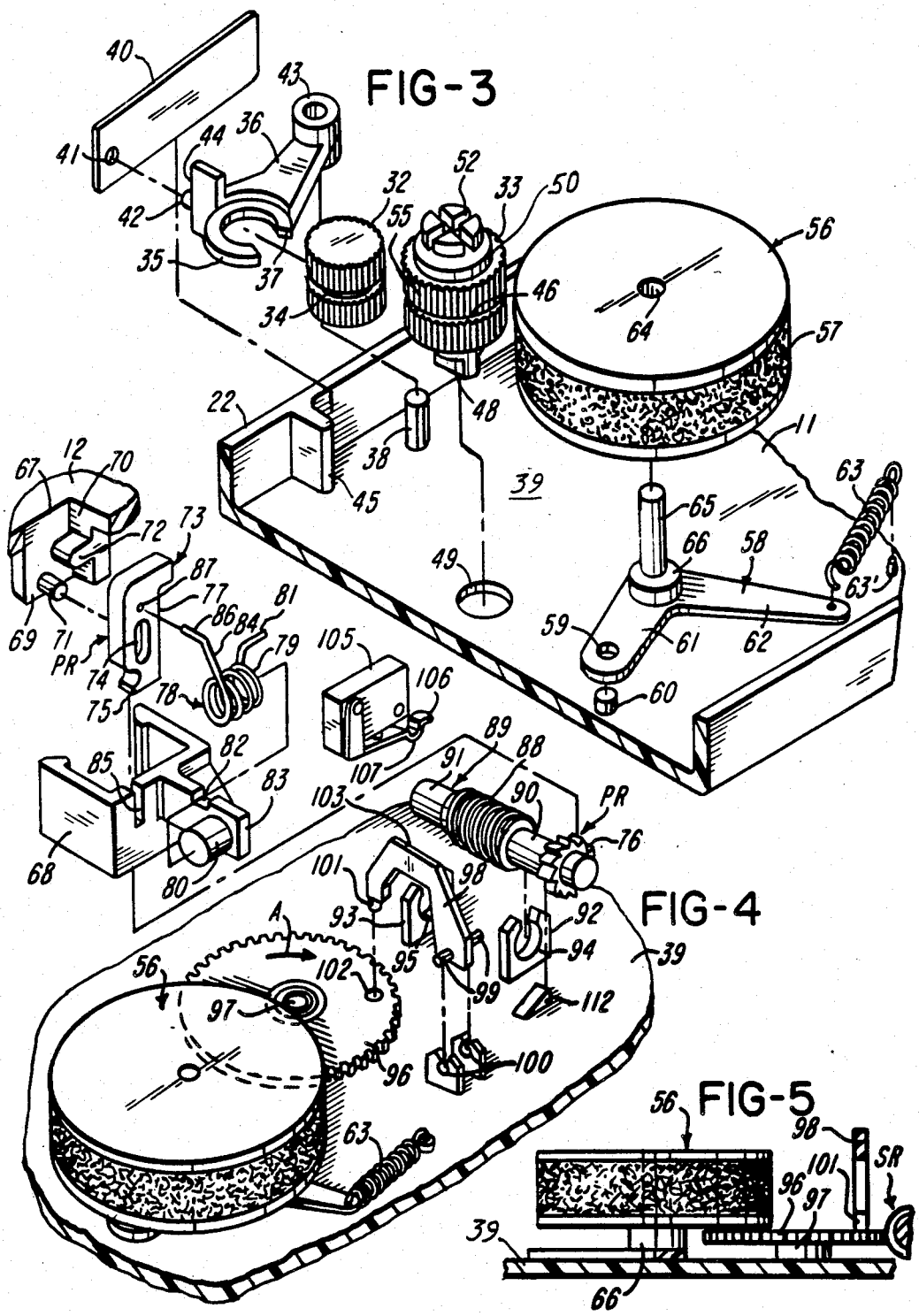
FIG. 3 is an exploded perspective view of a ribbon feeding mechanism and inking mechanism.
FIG. 4 is an exploded perspective view of the counting and indicating means of the cartridge.
FIG. 5 is a partly sectional view showing the fountain roll, the worm wheel, a portion of the worm gear and the sensing member.

The ink ribbon 15 passes into the chamber 17 from a passageway 28 in the arm 24 and passes partly around pins 29, 30 and 31 into the nip of cooperating rolls 32 and 33. With reference to FIG. 3, the roll 32 has a central annular groove 34 in which a socket 35 of a pivotally mounted arm or lever 36 is received. The socket 35 has an opening 37, but the extent of the socket 35 is more than 180 degress so that the roll 32 is held captive. The arm 36 and its socket 35 are constructed of one-piece molded plastics material and the socket 35 is sufficently resilient to spread to accept the roll 32. The arm 36 is pivotally mounted on a post 38 extending upwardly from the bottom wall 39 of the housing 11. A spring 40 acting on the lever 36 urges the roll 32 against the roll 33. The spring 40 is a leaf spring having a hole 41 for receiving a pin 42. The leaf spring 40 bears against a hub 43 of the lever 36 and against a head 44 adjacent the socket 35. The leaf spring 40 also bears against a projection 45 formed integrally with the side wall 22. The feed roll 33 has an annular groove 46 for receiving a stripper 47. The roll 33, which is of one-piece molded plastics construction, has an integral hub 48 rotatably received in a hole 49 in the bottom wall 39. The roll 33 has an integral hub 50 rotatably received in a hole 51 in the cover 12. The roll 33 has a cross-shaped slot 52 by which the roll 33 can be driven by suitable means outside the cartridge 10. Such means are shown in FIG. 1 as being an electric motor 53 having a rectangular drive end 54 which is adapted to be received in the slot 52 in one of two positions. The surface 55 of the roll 33 is sufficiently ink receptive to transfer ink from a fountain roll or roller generally indicated at 56 to the ink ribbon 15 which passes between the rolls 32 and 33. The fountain roll 56 has a hollow interior for receiving a supply of liquid ink. The outer surface of the fountain roll 56 is comprised of porous ink receptive material 57 which meters the ink to the roll 33. The fountain roll 56 is rotatably mounted on a bell-crank shaped lever or member 58. The lever 58 has a hole 59 for receiving an upstanding post 60 molded integrally with the bottom wall 39. The lever 58 has a pair of arms 61 and 62. A tension spring 63 is connected to the arm 62 and to an upstanding post 63' formed integrally with the bottom wall 39. The fountain roll 56 has a central hole 64 for receiving a post or pivot 65. The post 65 has a shoulder 66 which supports the fountain roller 56 in spaced relationship to the lever 58 and to the bottom wall 39. The spring 63 biases the fountain roll 56 into inking cooperation with the roll 33. The roll 33 can be considered to be a transfer roll 33 for transfering ink from the fountain roll 56 to the ink ribbon 15.

The cover 12 has a rectangular hole 67 for receiving a support 68. The cover 12 has a pair of joined depending walls 69 and 70. The wall 69 has an integrally formed pin 71 and the wall 70 has an integrally formed support 72. A pawl 73 has an elongated slot 74 into which the pin 71 extends. The pawl 73 has a tooth 75 for cooperating with a wheel-shaped ratchet or ratchet wheel 76. The pawl 73 has a surface 77 in supported contact with the support 72. The pin 71 and the support 72 guide the pawl 73 on its forward movement but allow the returning pawl 73 to pivot to clear the ratchet 76. A spiral spring 78 has turns 79 received on a post 80 molded integrally with the support 68. The spring 78 has a tang 81 received in a notch 82 of a member 83 which connects the support 68 and the post 80. The spring 78 also has a end portion 84 received in the slot 85. The end portion 84 has a tang 86 received in a hole 87 in the pawl 73. The spring 78 normally biases the pawl 73 in the upward direction to a home position as viewed in FIG. 4. The pin 71 engages the bottom of the slot 74 to limit its upward travel. The pawl 73 and the ratchet 76 form part of a pawl and ratchet mechanism PR. The ratchet 76, a worm gear 88 and a shaft 89 are of integrally molded plastics construction. The shaft 89 includes two spaced-apart shaft portions 90 and 91. The bottom wall 39 has a pair of upstanding sockets 92 and 93 for receiving and holding captive the respective shaft portions 90 and 91. Yet the sockets 92 and 93 resiliently open up to receive the respective shaft portions 90 and 91 due to the resilience of the material of which the sockets 92 and 93 are constructed. The sockets 92 and 93 have portions 94 and 95 which extend through more than 180 degrees but substantially less than 360 degrees. The worm gear 88 meshes with a worm wheel 96 mounted on an upstanding post or pivot 97. The pivot 97 is parallel to the pivot 65. The worm wheel 96 is shown to rotate in the direction of arrow A. As best seen in FIG. 5, the worm wheel 96 is disposed between and spaced from the bottom wall 39 and the fountain roller 56. A sensing member 98 is shown to have a pair of spaced shaft portions 99 received in spaced snap sockets 100 formed integrally with the bottom wall 39. The shaft portions 99 operating in the sockets 100 enable the member 98 to pivot from a position in which end portion or projection 101 of the member 98 rides on the side surface of the worm wheel 96 as shown in FIG. 5, but enables the sensing member 98 to pivot when a hole or recess 102 in the worm wheel 96 comes into engagement with the end portion 101. FIG. 4 shows end portion 101 aligned with the hole 102. When the end portion 101 enters the hole 102, the sensing nember 98 moves gravitationally to another or second position. The hole 102 moves in a circular path. The end portion 101 is in the path of the hole 102. The member 98 has a generally flat upper portion 103 aligned with a hole 104 (FIG. 1) in the cover 12. The printer P includes a switch 105 having a movable spring-urged sensing arm 106. The arm 106 has a U-shaped portion 107 which extends through the hole 104 and contacts the flat portion 103 of the member 98. So long as the member 98 is in the first position with the end portion 101 resting on the side surface of the worm wheel 96, the switch 105 is closed. However, as the end portion 101 enters the hole 102, the member 98 pivots counterclockwise as viewed in FIG. 4 and the arm 106 moves downwardly to open the switch 105 to provide a user-discernable signal or to render the printer P inoperable, or both. When the end portion 101 is aligned with the hole 102, the spring-urged arm 106 helps move the end portion 101 into the hole 102.

When assemblying the cartridge 10, the worm wheel 96, is so positioned that the end portion 101 contacts the side of the worm wheel 96 at a position at which the worm wheel 96 must make almost a complete revolution before the end portion 101 can enter the hole 102. The printer P includes a solenoid 108 coupled by a device 109 to a lever 110. The lever 110 pivots so that its free end portion 111 operates the pawl 73 in a downward direction as viewed in FIG. 4) and returns each time the solenoid causes the pawl 73 to advance the ratchet 76 by one increment. Reverse rotation of the ratchet 76 is prevented by means of an anti-backup pawl 112. Movement of the ratchet 76 causes the worm gear 88 to rotate through a small increment which causes the worm wheel 96 to rotate through an even smaller increment. The worm gear 88 and the worm wheel 96 comprises a speed reducer SR which is low-cost and easy to manufacture. The pawl 73, the ratchet 76, the worm gear 88 and the worm wheel 96 comprise a counter C which is advanced once for each operation of the solenoid 108. The solenoid 108 is operated through a counter from part of the printer P following the predetermined number of operations of the printer P. The counter C is advanced once for each operation of the solenoid 108.

It is a feature of the invention to make the counter C, the sensing member 98, and the ink ribbon 15 inaccessible to the user. The cover 12 is preferably attached to the housing 11 such as by permanent bonding. The ink ribbon 15 cannot be changed by the user. In addition, the counter C and the member 98 are non-resettable by the user because of their inaccessiblity inside the housing 11 to prevent the user from using the cartridge 10 after the inking medium, specifically, the ink ribbon 15 has essentially been spent. The compactness is facilitated by positioning the counter C and the fountain roller 56 in partly overlapping relationship with respect to each other. Moreover, many of the parts are molded integrally to keep the number of parts to a minimum. Although the inking mechanism according to a specific embodiment of the invention is an ink ribbon, the features of the invention are applicable to a replaceable cartridge in which the inking medium is an ink pad or an ink roll.

The simplicity and ease of manufacture are made possible by molding most of the components parts using moldable plastics material. All the parts of the cartridge 10 are molded except the springs 27, 40, 63 and 78 which are preferably metal and the ribbon 15 which can be made of any suitable ribbon material. The porous material 57 can be made of any suitable material for metering ink. The member 58 can be made of either metal or plastic.

Other embodiments and modifications of this invention will suggest themselves to those skilled in the art, and all such of these as come within the spirit of this invention are included within its scope as best defined by the appended claims.

I claim:

1. A replaceable inking cartridge, comprising: a cartridge housing, an ink ribbon disposed partly inside the housing but extending outside the housing and adapted to ink printing means, means for advancing the ink ribbon, a counter disposed in the housing, a member disposed in the housing, responsive to the counter, and movable from a first position to a second position for indicating a spent condition of the ink ribbon, wherein the counter includes a rotatable worm wheel having a side surface and a meshing worm gear, the member having a projection for riding on the side surface, a recess in the side surface, the projection being disposed in a path made by the recess as the worm wheel rotates, the member being movable from the first position to the second position upon movement of the projection into the recess when the projection is aligned with the recess, a pawl movably mounted by the housing, and a ratchet coupled to the worm gear and operable by the pawl.

2. A replaceable inking cartridge, comprising: a cartridge housing, an ink ribbon disposed partly inside the housing but extending outside the housing and adapted to ink printing means, means for advancing the ink ribbon, a counter disposed in the housing, a member disposed in the housing, responsive to the counter, and movable from a first position to a second position for indicating a spent condition of the ink ribbon, wherein the counter includes a rotatable worm wheel having a side surface and a meshing worm gear, the member having a projection for riding on the side surface, a recess in the side surface, the projection being disposed in a path made by the recess as the worm wheel rotates, the member being movable from the first position to the second position upon movement of the projection into the recess when the projection is aligned with the recess, wherein the counter includes a pawl movably mounted by the housing, a ratchet coupled to the worm gear and operable by the pawl, a printer, the printer including means for operating the pawl, and the printer further including means responsive to the member for disabling the printer when the projection is in the second position.

3. A replaceable inking cartridge, comprising: an essentially closed cartridge housing having first and second chambers, means defining an opening interconnecting the first and second chambers, the first chamber comprising a stuffing chamber, the housing having a pair of outwardly extending arms, an endless ink ribbon, means defining a path from the stuffing chamber, through one arm, to and through the other arm, to and through the second chamber, through the opening and into the stuffing chamber, a pair of cooperating first and second rolls disposed at the opening, the first roll having means enabling rotation of the first roll from outside the housing, the pivotally mounted member disposed in the second chamber, a first pivot secured to the member and having a shoulder spaced from the member, a fountain roll mounted on the first pivot in contact with the shoulder, a spring for biasing the member to urge the fountain roll against the first roll, a pawl movably mounted by the housing and being operable from outside the housing, a ratchet wheel disposed in the housing and operable by the pawl, a worm gear coupled to the ratchet wheel, a worm gear and the ratchet wheel being integrally molded of one-piece plastics material, a worm wheel meshing with the worm gear, a second pivot disposed parallel to the first pivot for mounting the worm wheel, the worm wheel being disposed between and spaced from a portion of the housing and the fountain roll, the worm wheel having a side surface, a sensing member having a projection for contacting the side surface, a hole in the worm wheel, the hole being movable in a circular path when the worm wheel rotates, the projection being disposed in the circular path and being movable into the hole when the projection and the hole are aligned, and a hole in the housing for accessing the sensing member to signal whether the sensing member is in a first position with the projection in contact with the side of the worm wheel or in a second position in which the projection is in the hole in the worm wheel.

4. A replaceable inking cartridge, comprising: an essentially closed cartridge housing having first and second chambers, means defining an opening interconnecting the first and second chambers, the first chamber comprising a stuffing chamber, the housing having a pair of outwardly extending arms, an endless ink ribbon, means defining a path from the stuffing chamber, through one arm, to and through the other arm, to and through the second chamber, through the opening and into the stuffing chamber, a pair of cooperating first and second feed rolls disposed at the opening, a fountain roll for inking the first roll, a pawl movably mounted by the housing and being operable from outside the housing, a ratchet wheel disposed in the housing, a worm gear coupled to the ratchet wheel, a worm wheel meshing with the worm gear, the worm wheel having a side surface, a sensing member having a projection for contacting the side surface, a hole in the worm wheel, the hole being movable in a circular path when the worm wheel rotates, the projection being disposed in the circular path and being movable into the hole when the projection and the hole are aligned, and a hole in the housing for accessing the sensing member to signal whether the sensing member is in a first position with the projection in contact with the side of the worm wheel or in a second position in which the projection is in the hole in the worm wheel.

5. A replaceable inking cartridge, comprising: an essentially closed cartridge housing having first and second chambers, means defining an opening interconnecting the first and second chambers, the first chamber comprising a stuffing chamber, the housing having a pair of outwardly extending arms, an endless ink ribbon, means defining a path from the stuffing chamber, through one arm, to and through the other arm, to and through the second chamber, through the opening and into the stuffing chamber, a pair of cooperating first and second feed rolls disposed at the opening, a worm gear, means in the housing for moving the worm gear, a worm wheel meshing with the worm gear, the worm wheel having a side surface, a sensing member having a projection for contacting the side surface, a hole in the worm wheel, the hole being movable in a circular path when the worm wheel rotates, the projection being disposed in the circular path and being movable into the hole when the projection and the hole are aligned, and a hole in the housing for accessing the sensing member to signal whether the sensing member is in a first position with the projection in contact with the side of the worm wheel or in a second position in which the projection is in the hole in the worm wheel.

6. A replaceable inking cartridge, comprising: an essentially closed cartridge housing having first and second chambers, means defining an opening interconnecting the first and second chambers, the first chamber comprising a stuffing chamber, the housing having a pair of outwardly extending arms, an endless ink ribbon, means defining a path from the stuffing chamber, through one arm, to and through the other arm, to and through the second chamber, through the opening and into the stuffing chamber, a pair of cooperating first and second feed rolls disposed at the opening, a pawl movably mounted by the housing and being operable from outside the housing, a ratchet wheel disposed in the housing and operable by the pawl, a speed reducer coupled to the ratchet wheel, the speed reducer including a gear, the gear having a side surface, a sensing member having a projection for contacting the side surface, a hole in the gear, the hole being movable in a circular path when the gear rotates, the projection being disposed in the circular path and being movable into the hole when the projection and the hole are aligned, and a hole in the housing for accessing the sensing member to signal whether the sensing member is in a first position with the projection in contact with the side of the gear or in a second position in which the projection is in the hole in the gear.

7. A replaceable inking cartridge, comprising: an essentially closed cartridge housing having first and second chambers, means defining an opening interconnecting the first and second chambers, the first chamber comprising a stuffing chamber, the housing having a pair of outwardly extending arms, an endless ink ribbon, means defining a path from the stuffing chamber, through one arm, to and through the other, to and through the second chamber, through the opening and into the stuffing chamber, a pair of cooperating first and second feed rolls disposed at the opening, a pawl movably mounted by the housing and being operable from outside the housing, a ratchet wheel disposed in the housing and operable by the pawl, a wheel coupled to the ratchet wheel and having a side surface, a sensing member having a projection for contacting the side surface, a hole in the wheel, the hole being movable in a circular path when the wheel rotates, the projection being disposed in the circular path and being movable into the hole when the projection and the hole are aligned, and a hole in the housing for accessing the sensing member to signal whether the sensing member is in a first position with the projection in contact with the side of the wheel or in a second position in which the projection is in the hole in the wheel.

8. A replaceable inking cartridge, comprising: a cartridge housing including a cover, an ink ribbon, the housing defining space, the space including first and second chambers, the first chamber comprising a stuffing chamber, a portion of the ink ribbon being stuffed in the stuffing chamber, another portion of the ink ribbon extending outside the housing and adapted to ink printing means, means in the housing for advancing the ink ribbon, a counter disposed in the second chamber in a position inaccessible for resetting without removing the cover, a member disposed in the housing, responsive to the counter and movable in the space from a first position to a second position for indicating a spent condition of the ink ribbon, wherein the counter includes a rotatable worm wheel having a side surface and a meshing worm gear, the member having a projection for riding on the side surface, a recess in the side surface, and the projection being disposed in a path made by the recess as the worm wheel rotates, and the member being movable from the first position to the second position upon movement of the projection into the recess when the projection is aligned with the recess.

9. A replaceable inking cartridge, comprising, a cartridge housing including a cover, an ink ribbon, the housing defining space, the space including first and second chambers, the first chamber comprising a stuffing chamber, a portion of the ink ribbon being stuffed in the stuffing chamber, another portion of the ink ribbon extending outside the housing and adapted to ink printing means, means in the housing for advancing the ink ribbon, a counter disposed in the second chamber in a position inaccessible for resetting without opening the cover, a movable member disposed in the second chamber, responsive to the counter and movable from a first position to a second position for indicating a spent condition of the ink ribbon, wherein the counter includes a pawl mounted by the housing, a ratchet operable by the pawl, and a speed reducer coupled to the ratchet, and the member being movable from the first position to the second position in response to operation of the pawl, the ratchet and the speed reducer.

10. A replaceable inking cartridge, comprising: a cartridge housing including a cover, a multiple-pass ink ribbon held captive by the housing, the housing defining space, the space including first and second chambers, the first chamber comprising a stuffing chamber, a portion of the ink ribbon being stuffed in the stuffing chamber, another portion of the ink ribbon extending outside the housing and adapted to ink printing means, a counter disposed in the second chamber in a position inaccessible for resetting without opening the cover, wherein the counter includes a pawl and ratchet mechanism operated as the ink ribbon is used, and means including a movable member disposed in the second chamber and responsive to the counter when the counter has accumulated a predetermined count for indicating the spent condition of the ink ribbon.

11. A cartridge as defined in claim 10, wherein the counter includes a speed reducer driven by the pawl and ratchet mechanism.

12. A replaceable inking cartridge, comprising: a housing including a cover, the housing defining space, the space including a stuffing chamber, an endless ink ribbon, a portion of the ink ribbon being stuffed in the stuffing chamber, another portion of the ink ribbon extending to a zone outside the housing and adapted to cooperate with printing means, means mounted on the housing for feeding the ribbon, a counter, a movable member disposed in a second chamber and responsive to the counter for indicating when the cartridge needs to be replaced, wherein the counter includes a pawl and ratchet mechanism and a speed reducer driven by the pawl and ratchet mechanism, and wherein the counter is disposed in the space but outside the stuffing chamber in a location inaccessible for resetting without opening the cover.

13. A replaceable inking cartridge, comprising: a cartridge housing including a cover, means in the housing defining first and second interconnected chambers, the first chamber comprising a stuffing chamber, an endless ink ribbon, a portion of the ink ribbon being stuffed in the stuffing chamber, another portion of the ink ribbon extending to a zone outside the housing and adapted to ink printing means, means in the housing for feeding the ribbon, a movable member disposed in the second chamber, and means including cooperable members disposed in the second chamber and inaccessible for resetting by the user without opening the cover to operate the movable member for indicating when the cartridge needs to be replaced, and wherein the cooperable members includes a pawl and ratchet mechanism and a speed reducer driven by the pawl and ratchet mechanism.

14. A replaceable inking cartridge, comprising: a cartridge housing, means in the housing defining first and second interconnected chambers, the first chamber comprising a stuffing chamber, an endless ink ribbon, a portion of the ink ribbon being stuffed in the stuffing chamber, another portion of the ink ribbon extending to a zone outside the housing and adapted to cooperate with printing means, means in the housing for feeding the ribbon, and means including cooperable member disposed in the second chamber and non-resettable by the user for indicating when the cartridge needs to be replaced, wherein the cooperable members comprise a pawl and ratchet mechanism and a speed reducer driven by the pawl and ratchet mechanism, wherein the feeding means includes a pair of cooperating rolls disposed in the housing in feeding contact with the ink ribbon, one of the rolls being an ink transfer roll, an ink roll disposed in the second chamber for inking the ink transfer roll, and a portion of the ink roll being disposed in overlapping relationship relative to a portion of the speed reducer.

* * * * *

UNITED STATES PATENT AND TRADEMARK OFFICE

CERTIFICATE OF CORRECTION

PATENT NO. : 4,636,097

DATED : January 13, 1987

INVENTOR(S) : Donald E. Goubeaux

It is certified that error appears in the above-identified patent and that said Letters Patent are hereby corrected as shown below:

Column 6, line 20, "a" should be --the--. Column 7, line 54, after "other" --arm-- has been omitted. Column 10, line 1, "includes" should be --include--; line 12, "member" should be --members--.

Signed and Sealed this

Sixth Day of October, 1987

*Attest:*

DONALD J. QUIGG

*Attesting Officer*

*Commissioner of Patents and Trademarks*